US006094115A

United States Patent [19]

Nguyen et al.

[11] Patent Number: 6,094,115

[45] Date of Patent: Jul. 25, 2000

[54] CONTROL IMPEDANCE RF PIN FOR EXTENDING COMPRESSIBLE BUTTON INTERCONNECT CONTACT DISTANCE

[75] Inventors: Dung T. Nguyen, Fountain Valley; Claudio S. Howard, Hawthorne; Clifton Quan, Arcadia, all of Calif.

[73] Assignee: Raytheon Company, Lexington, Mass.

[21] Appl. No.: 09/249,523

[22] Filed: Feb. 12, 1999

[51] Int. Cl.[7] ..... H01P 1/00

[52] U.S. Cl. ..... 333/260; 333/246; 439/66

[58] Field of Search ..... 333/260, 246, 333/243; 439/930, 66; 361/785

[56] References Cited

U.S. PATENT DOCUMENTS

| | | | |
|---|---|---|---|
| 5,552,752 | 9/1996 | Sturdivant et al. | 333/243 |
| 5,633,615 | 5/1997 | Quan | 333/33 |
| 5,668,509 | 9/1997 | Hoffmeister et al. | 333/33 |
| 5,675,302 | 10/1997 | Howard et al. | 333/243 |
| 5,689,216 | 11/1997 | Sturdivant | 333/33 |
| 5,703,599 | 12/1997 | Quan et al. | 342/368 |

OTHER PUBLICATIONS

Product Data Sheet for Gilbert GPO Interconnect System, Gilbert Engineering Co., Inc., 4 pages, 1992.

*Primary Examiner*—Paul Gensler
*Assistant Examiner*—Kimberly E Glenn
*Attorney, Agent, or Firm*—Leonard A. Alkov; Glenn H. Lenzen, Jr.

[57] ABSTRACT

An interconnect structure defining an interconnect transmission line for RF signal interconnection between two substrates. The interconnect structure includes an outer shield member forming an electrically conductive outer shield structure. A solid conductor pin is sized to form an inner conductor, the pin having a first pin diameter, and a head region of a second pin diameter greater than the first pin diameter, said head region formed intermediate a first pin end and a second pin end. A first dielectric tube member has an outer diameter sized in relation to an opening dimension of the shield member to fit tightly therein, and an inner tube diameter sized to receive tightly therein a first region of the pin of the first pin diameter, the first tube member having a first tube first end and a first tube second end. A second dielectric tube member has an outer diameter sized to fit tightly in the outer shield, and an inner tube diameter sized to receive tightly therein a second region of the pin. The tubes fit within the shield to capture the pin head region. Wire bundles fabricated of densely packed wire are packed within the tubes in compression against the ends of the solid conductor pin, and protrude from the ends of the shield for making electrical contact with surfaces of mating substrates.

15 Claims, 2 Drawing Sheets

CONTROL IMPEDANCE RF PIN FOR EXTENDING COMPRESSIBLE BUTTON INTERCONNECT CONTACT DISTANCE

TECHNICAL FIELD OF THE INVENTION

The present invention relates to RF connection devices, and more particularly to a compressible button interconnect structure for vertical interconnection between two substrates regardless of the separation distance.

BACKGROUND OF THE INVENTION

There is a need in many microwave applications for providing RF interconnections between adjacent substrates or circuit boards. Conventional techniques for interconnecting circuit boards include the use of cables. The disadvantages to these methods include size, weight, and cost.

RF connections using compressed wire bundles have in the past typically used at least 20% compression for proper operation, and did not extend in length more than one bundle diameter from its retainer to prevent buckling. For example, with a connector using a wire bundle having a 0.020 inch diameter, this restricts the bundle to 0.080 inch in length. A further problem is that, if the wire bundle is positioned in a through hole, the compression forces at each end of the wire bundle are not equal, due to the sequence of installation. For example, the bundle end that is compressed first will force the bundle further into the hole and the other end will protrude more from the opposed end of the through hole, and this end of the bundle is more at risk of buckling when compressed.

While the interconnects described in U.S. Pat. No. 5,675,302 maintain constant impedance, these interconnects do not address the issue of how to hold the dielectric and pin in place under vibration.

Commercially available compressed wirebundle interconnect structures are available with internal pins for DC and low frequency signals. However, conventional techniques of capturing the pin typically require the pin itself to have a larger diameter than that of the wire bundle contact. Also, epoxies are required to hold the pin and dielectric elements of the interconnect structure together. The combination of all these process steps make the objectives of maintaining control and uniform impedance at microwave frequencies difficult if not impossible.

Conventional coaxial connectors typically employ a barb machined onto the pin to hold it in place within the dielectric. However the outer conductor must be modified using complex machining to maintain good impedance control.

SUMMARY OF THE INVENTION

A new interconnect technique is described which allows the application of compressed wire bundle conductor structures for vertical interconnection and RF signal transmission between two substrates regardless of the substrate separation distance. The invention also provides a technique of maintaining a constant impedance of the interconnection structure without generating signal noise under vibration. In an exemplary embodiment, a 50 ohm characteristic impedance can be easily maintained in a simple mixed dielectric media without complicating the outer conductor shield of the coaxial interconnection structure. The structure employs a pin structure whose position within the dielectric material is locked and will not move under vibration, and thus will not generate signal noise. The locking of the dielectric and pin structure requires no epoxy bonds in an exemplary embodiment.

An exemplary interconnect structure in accordance with the invention includes an outer shield member having a through hole formed therein, a wall of the hole forming an electrically conductive outer shield structure, the through hole having an interconnect length defined along an axis thereof. A solid conductor pin is sized to form an inner conductor for the interconnect transmission line, the pin having a first pin diameter, and a head region of a second pin diameter greater than the first pin diameter. The head region is formed intermediate a first pin end and a second pin end, the pin having a length less than the interconnect length. A dielectric tube structure has an outer diameter sized in relation to an opening dimension of the through hole to fit tightly within the through hole, and an inner tube opening diameter sized to receive tightly therein regions of the pin of the first pin diameter, the tube structure having a first end and a second end. An air gap is defined in a circumferential region between the pin head and the outer shield structure. A first wire bundle is fabricated of densely packed wire packed in the first end of the tube opening and having a first end and a second end, the first end in compression against the first end of the solid conductor pin, the second end of the first wire bundle protruding from the first end of the through hole for making electrical contact with a surface of a mating first substrate. A second wire bundle is fabricated of densely packed wire packed within the second end of the tube opening and having a first end and a second end, the first end in compression against the second end of the solid conductor pin, the second end of the second wire bundle protruding from the second end of the through hole for making electrical contact with a surface of a mating second substrate.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENTS

Figure 1:
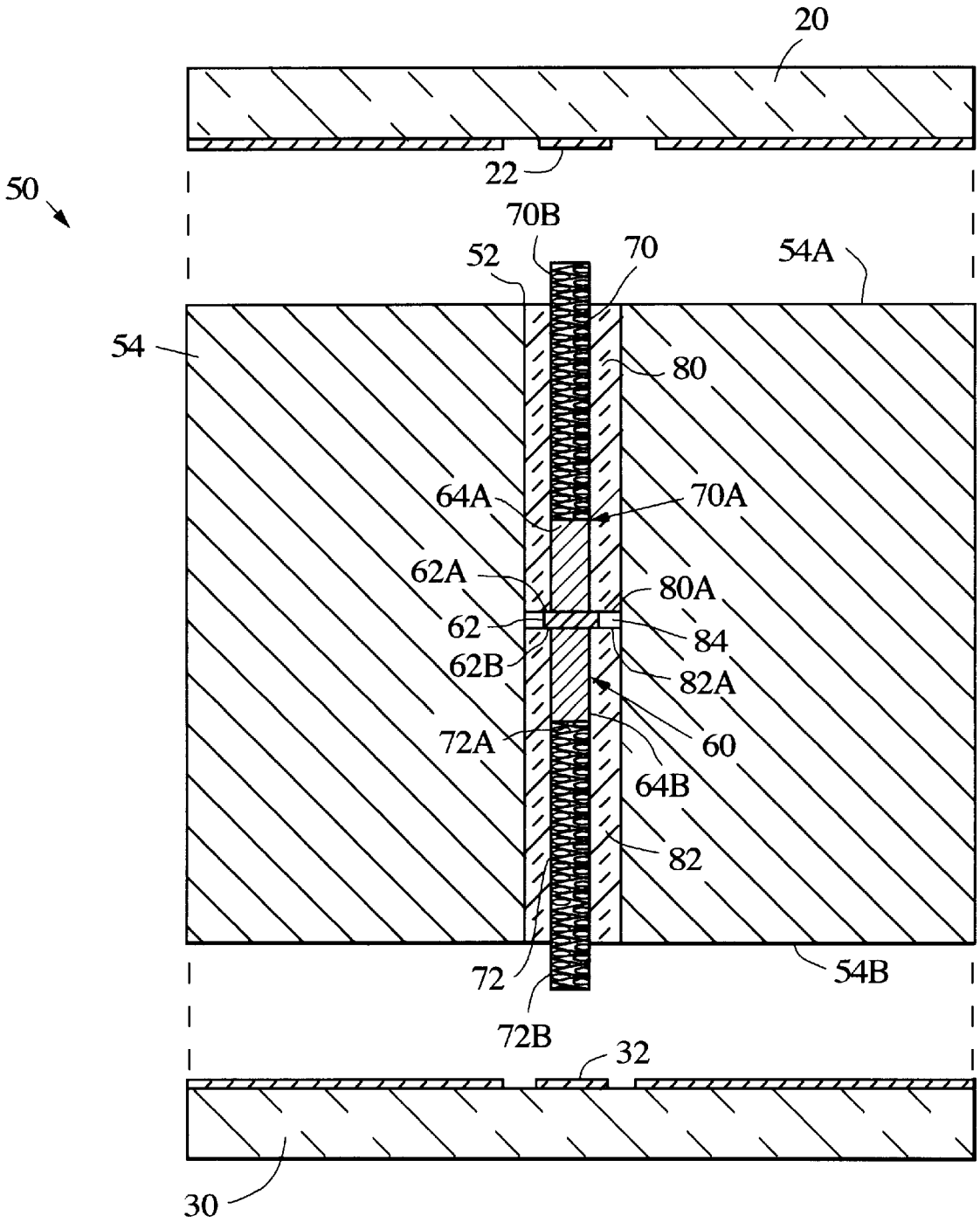
FIG. 1 is a cross-sectional view taken along an axis of an interconnect structure in accordance with the invention.

An exemplary interconnect structure 50 in accordance with the invention is illustrated in FIG. 1, and includes a solid conductor pin 60 positioned in a through hole 52 formed in a housing 54 between two bundles 70, 72 of densely packed thin wire, to form a compressible and continuous electrically conductive contact structure. The housing 54 is fabricated from an electrically conductive material such as aluminum. The wire bundles and the pin are held together by two dielectric sleeves or tubes 80, 82, which in an exemplary embodiment are fabricated of Teflon (™). In an exemplary embodiment, the bundles 70, 72 have a diameter of 0.020 inch; the tubes 80, 82 have an inner diameter equal to the diameter of the bundles. The pin 60 has a diameter of 0.020 inch, i.e. equal to the diameter of the wire bundles 70, 72, and has a head 62 formed intermediate its ends 64A, 64B. The head 62 is defined by a step increase in the pin diameter, to a diameter in this embodiment of 0.029 inch, forming shoulder surfaces 62A, 62B. In this exemplary embodiment, the bundle is fabricated of cylindrical wire having a thickness in the range of 1 mil to 2 mils.

Between the adjacent ends 80A, 82A of the dielectric tubes, there is an air gap 84 whose length is controlled by the shoulder surfaces 62A, 62B defined on the pin. The purpose of the air gap is to maintain the same characteristic impedance of the interconnect structure in the air gap region as in the regions of the dielectric tubes 80, 82. Thus, across the distance of the air gap, the diameter of the conductor pin 60 increases to maintain constant impedance. In this exemplary embodiment, the outer conductor shield formed by the conductive wall defining the through hole 52 has a constant diameter across the entire interconnect length.

In an assembled state, one end 70A of the wire bundle 70 is in compressive contact with the end 64A of the solid pin 60, and its opposite end 70B protrudes from an end of the through hole 52, i.e. above the surface 54A of the housing 54. Similarly, one end 72A of the wire bundle 72 is in compressive contact with the end 64B of the solid pin 60, and its opposite end 72B protrudes from the opposite end of the through hole 52, i.e. out from the surface 54B of the housing. In an exemplary embodiment, the end of the wire bundle will protrude from the surface 54B by a distance of 0.004 inch to 0.015 inch.

In an exemplary embodiment with a 50 ohm characteristic impedance, the outer conductor shield has a diameter of 0.066 inch, the through hole a length of 0.225 inch, the solid pin a length of 0.128 inch, and the pin head a length of 0.008 inch.

The interconnect structure 50 can be assembled in the following exemplary manner. The solid pin 60 is first assembled to the two tubes 80, 82, by insertion into the tube openings. The pin is sized to tightly fit into the tube openings, and will be held in place by the interference fit. The two wire bundles 70, 72 can then be inserted into the respective tube openings, and will be held in place by the tight interference fit. This conductor/dielectric tube assembly can then be pushed into the housing opening 52. Here again, the tube outer diameter is sized relative to the opening 52 diameter to provide a tight interference fit of the tubes in the opening. The length of the tubes and the pin head are selected so that the exposed ends of the tubes fit flush with the surfaces 54A and 54B of the housing.

In a preferred embodiment, the interconnect structure 50 is assembled without the use of adhesives such as epoxy, the various parts held in place through the tightness of the interference fit as described above.

Figure 2:
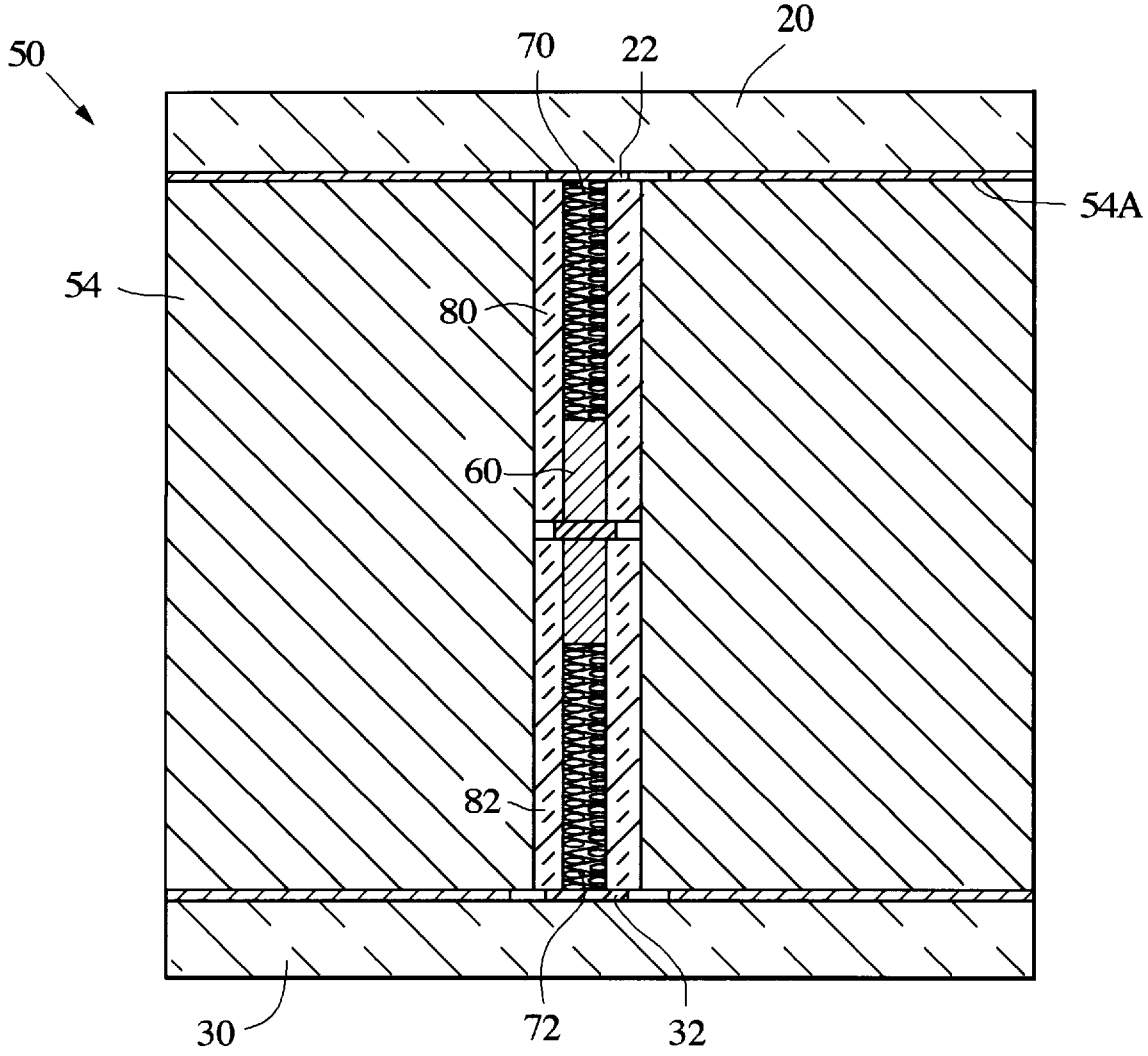
FIG. 2 is a view similar to FIG. 1 but with substrates positioned in assembly with the connector.

In this exemplary embodiment, the interconnect 50 is to make an RF connection between flat conductive regions on two separated substrates, and is shown in FIG. 1 with substrates 20, 30 separated from the connector 50. Each substrate has a conductive region 22, 32 which may define a circuit trace, or a conductor pad. FIG. 2 shows the interconnect in assembled form between the two substrates, making an RF connection between the regions 22, 32. The substrates and connector can be held in the assembled state by clamping the connector between the substrates, or by otherwise securing the substrates in position in an assembly.

A constant impedance along the interconnect structure is provided by inserting an equivalent air dielectric transmission line segment in the center of the interconnect structure. While described in an exemplary embodiment in the context of coaxial transmission lines, this techniques is applicable for other types of RF transmission lines such as slabline, square-ax (square rectangular coaxial transmission line), and three-wire transmission lines. These types of transmission lines all employ a conductor disposed within a dielectric structure, and outer conductive shield structures. This is accomplished while maintaining constant outer conductor dimensions.

Once the interconnect is engaged between the substrates, all components are firmly held in place without the need for epoxy capture. This is due to the capturing of the solid pin in place between the two tube structures, the tight interference fit of the tube structures in the outer housing opening, and the tight interference fit of the wire bundles within the tube structures. Analysis predicts mode free performance up to 18 Ghz, i.e. producing only the fundamental coaxial mode without higher order waveguide modes, from the enhanced 20 mil diameter compressed wire bundle connector.

This invention solves the problems associated with using compressed wire bundles to make a vertical interconnect over a long distance. Ideally the wire bundles are reliable when their lengths are limited to 0.080 inch (for 0.020 inch diameter bundle) so that the protruding portion that would be compressed when installed is less than the diameter of the button so that it will not buckle. The solid pin can be extended in length as needed to meet a particular interconnect distance requirement, while using wire bundles of the same length limited to 0.080 inch, and thereby will allow an unlimited distance between items to be connected with wire bundles installed at both interfaces. This has many potential uses where vertical interconnects are needed.

One exemplary application for the interconnect structure of this invention is to provide RF interconnection between stacked substrates within radar transmit/receive modules.

This invention introduces a new technique that solves the problems associated with using compressed wire bundles to make a vertical interconnect over long distance while maintaining constant impedance at microwave frequencies and while securing the interconnect components from moving under vibration. This new technique is much simpler to fabricate and assemble than what can be accomplished using known techniques.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An interconnect structure providing an interconnect transmission line having an interconnect length for RF signal interconnection between two separated substrates, the interconnect structure comprising:

a solid conductor pin sized to form an inner conductor for the interconnect transmission line, the pin having a first pin diameter, and a head region of a second pin diameter greater than the first pin diameter, said head region formed intermediate a first pin end and a second pin end, the pin having a length less than the interconnect length;

a dielectric tube structure having an outer diameter and an inner tube opening diameter sized to receive tightly therein regions of the pin of the first pin diameter, the tube structure having a first end and a second end;

an air gap defined in a circumferential region around the pin head region;

a first wire bundle fabricated of densely packed wire packed in the first end of the tube opening and having a first end and a second end, the first end in compression against the first end of the solid conductor pin, the second end of the first wire bundle protruding from the first end of the through hole for making electrical contact with a surface of a mating first substrate; and a second wire bundle fabricated of densely packed wire packed within the second end of the tube opening and having a first end and a second end, the first end in compression against the second end of the solid conductor pin, the second end of the second wire bundle protruding from the second end of the through hole for making electrical contact with a surface of a mating second substrate.

2. The interconnect structure of claim 1 further comprising an outer shield member having a through hole formed therein, a wall of the hole forming an electrically conductive outer shield structure, the through hole having an interconnect length defined along an axis thereof, the dielectric tube structure fitted tightly within the through hole.

3. The interconnect structure of claim 2 wherein the pin, the tube structure, the first wire bundle and the second wire bundle are secured in said through hole without adhesive bonding.

4. The interconnect structure of claim 3 wherein the interconnect transmission line is a coaxial transmission line, and said outer shield forms a coaxial outer shield.

5. The interconnect structure of claim 2 wherein the outer shield, solid conductor pin, said tube structure, and first and second wire bundles have circular symmetry about the axis, and wherein diametrical dimensions of the outer shield, solid conductor pin, said tube structure, and first and second wire bundles are selected to provide a constant characteristic impedance of said interconnect transmission line along the interconnect length.

6. The interconnect structure of claim 5 wherein said outer shield through hole has a constant diameter through the interconnect length.

7. An interconnect structure providing an interconnect transmission line for RF signal interconnection between two separated parallel substrates, the interconnect structure comprising:

an outer shield member having a through hole formed therein, a wall of the hole forming an electrically conductive outer shield structure, the through hole having an interconnect length defined along an axis thereof;

a solid conductor pin sized to form an inner conductor for the interconnect transmission line, the pin having a first pin diameter, and a head region of a second pin diameter greater than the first pin diameter, said head region formed intermediate a first pin end and a second pin end, the head region having a head length and defining first and second pin shoulder surfaces at a transition between the first pin diameter and the second pin diameter, the pin having a length less than the interconnect length;

a first dielectric tube member having an outer diameter sized in relation to an opening dimension of the through hole to fit tightly within the through hole, and an inner tube diameter sized to receive tightly therein a first region of the pin of the first pin diameter, the first tube member having a first tube first end and a first tube second end;

a second dielectric tube member having an outer diameter sized in relation to an opening dimension of the through hole to fit tightly within the through hole, and an inner tube diameter sized to receive tightly therein a second region of the pin of the first pin diameter, the second tube member having a second tube first end and a second tube second end;

the first tube and the second tube fitted within the through hole to capture between the pin head region between the first tube first end and the second tube first end, the first tube extending to a first through hole end, the second tube extending to a second through hole end;

a first wire bundle fabricated of densely packed wire packed within the first tube and having a first end and a second end, the first end in compression against the first end of the solid conductor pin, the second end of the first wire bundle protruding from the first end of the through hole for making electrical contact with a surface of a mating first substrate; and a second wire bundle fabricated of densely packed wire packed within the second tube and having a first end and a second end, the first end in compression against the second end of the solid conductor pin, the second end of the second wire bundle protruding from the second end of the through hole for making electrical contact with a surface of a mating second substrate.

8. The interconnect structure of claim 7 further including an air gap defined at the head region between the first end of the first tube and the first end of the second tube, and wherein the interconnect transmission line has a constant characteristic impedance, the air gap providing an impedance compensation for the increase in the pin diameter at the head region.

9. The interconnect structure of claim 7 wherein the pin, the first tube and the second tube, the first wire bundle and the second wire bundle are secured in said through hole without adhesive bonding.

10. The interconnect structure of claim 7 wherein the interconnect transmission line is a coaxial transmission line, and said outer shield forms a coaxial outer shield.

11. The interconnect structure of claim 7 wherein the outer shield, solid conductor pin, first and second tube member, and first and second wire bundles have circular symmetry about the axis, and wherein diametrical dimensions of the outer shield, solid conductor pin, first and second tube member, and first and second wire bundles are selected to provide a constant characteristic impedance of said interconnect transmission line along the interconnect length.

12. The interconnect structure of claim 11 wherein said outer shield through hole has a constant diameter through the interconnect length.

13. A method of providing an RF interconnection between two separated substrates, comprising the steps of:

providing an outer shield member having a through hole formed therein, a wall of the hole forming an electrically conductive outer shield structure, the through hole having an interconnect length defined along an axis thereof which is equal to the separation distance of the two substrates;

providing a solid conductor pin sized to form an inner conductor for the interconnect transmission line, the pin having a first pin diameter, and a head region of a second pin diameter greater than the first pin diameter, said head region formed intermediate a first pin end and a second pin end, the head region having a head length and defining first and second pin shoulder surfaces at a transition between the first pin diameter and the second pin diameter, the pin having a length less than the interconnect length;

inserting one end of the pin into a first dielectric tube member having an outer diameter sized in relation to an opening dimension of the through hole to fit tightly within the through hole, the tube inner tube diameter sized to receive tightly therein a first region of the pin of the first pin diameter, the first tube member having a first tube first end and a first tube second end;

inserting a second end of the pin into a second dielectric tube member having an outer diameter sized in relation to an opening dimension of the through hole to fit tightly within the through hole, to capture the pin head region between the first tube first end and the second tube first end, the tube inner tube diameter sized to receive tightly therein a second region of the pin of the first pin diameter, the second tube member having a second tube first end and a second tube second end;

inserting a first wire bundle fabricated of densely packed wire packed within the first tube and having a first end and a second end, the first end in compression against the first end of the solid conductor pin, the second end of the first wire bundle protruding from the first end of the first tube;

inserting a second wire bundle fabricated of densely packed wire packed within the second tube and having a first end and a second end, the first end in compression against the second end of the solid conductor pin, the second end of the second wire bundle protruding from the first end of the second tube;

fitting the assembled interconnect structure including the solid pin, the first tube and the second tube, and the first and second wire bundles within the through hole, the first tube extending to a first through hole end, the second tube extending to a second through hole end;

assembling a first substrate against a first surface of the outer shield member and in compressive contact with said first wire bundle; and assembling a second substrate against a second surface of the outer shield member and in compressive contact with said second wire bundle, wherein an RF interconnect is established between the first and second substrates.

14. The method of claim 13 wherein the outer shield, solid conductor pin, first and second tube member, and first and second wire bundles have circular symmetry about the axis, and further comprising the step of selecting the diametrical dimensions of the outer shield, solid conductor pin, first and second tube member, and first and second wire bundles to provide a constant characteristic impedance of said interconnect transmission line along the interconnect length.

15. The method of claim 14 wherein said outer shield through hole has a constant diameter through the interconnect length.

* * * * *